US006102122A

United States Patent [19]

de Rouffignac

[11] Patent Number: 6,102,122

[45] Date of Patent: Aug. 15, 2000

[54] CONTROL OF HEAT INJECTION BASED ON TEMPERATURE AND IN-SITU STRESS MEASUREMENT

[75] Inventor: Eric de Rouffignac, Houston, Tex.

[73] Assignee: Shell Oil Company, Houston, Tex.

[21] Appl. No.: 09/096,081

[22] Filed: Jun. 11, 1998

Related U.S. Application Data

[60] Provisional application No. 60/049,292, Jun. 11, 1997.

[51] Int. Cl.[7] ..... E21B 36/00; E21B 47/06

[52] U.S. Cl. ..... 166/302; 166/250.01; 166/272.1; 166/57; 166/64; 166/250.07; 73/152.17; 73/152.59; 73/9 R; 73/784

[58] Field of Search ..... 166/302, 57, 59, 166/60, 250.01, 250.07, 66, 64, 113, 272.1; 73/152.17, 152.59, 784, 152.01

[56] References Cited

U.S. PATENT DOCUMENTS

| | | | |
|---|---|---|---|
| 4,413,678 | 11/1983 | Gillespie | 166/57 |
| 4,640,352 | 2/1987 | Vanmeurs et al. | 166/245 |
| 4,886,118 | 12/1989 | Van Meurs et al. | 166/245 |
| 4,899,320 | 2/1990 | Hearn et al. | 367/35 |
| 5,060,287 | 10/1991 | Van Egmond | 392/301 |
| 5,065,818 | 11/1991 | Van Egmond | 166/60 |
| 5,190,405 | 3/1993 | Vinegar et al. | 405/128 |
| 5,255,742 | 10/1993 | Mikus | 166/303 |
| 5,297,626 | 3/1994 | Vinegar et al. | 166/271 |
| 5,318,116 | 6/1994 | Vinegar et al. | 166/60 |
| 5,392,854 | 2/1995 | Vinegar et al. | 166/271 |
| 5,433,271 | 7/1995 | Vinegar et al. | 166/272.1 |
| 5,517,593 | 5/1996 | Nenniger et al. | 392/301 |

*Primary Examiner*—Eileen Dunn Lillis
*Assistant Examiner*—John Kreck
*Attorney, Agent, or Firm*—Del S. Christensen

[57] ABSTRACT

The invention is a method to operate a heat injection well, the method comprising the steps of: providing a heat injection well comprising a metal casing and a controllable source of heat within the casing; determining the maximum temperature of the casing which can be applied to the metal casing as a function of external pressure; providing a formation stress measurement device within the formation in the vicinity of the wellbore; providing a temperature measurement device effective for determining the temperature of the casing; determining the formation stress during operation of the heat injection well; and controlling heat released from the controllable source of heat to maintain the formation stress below a predetermined fraction of the collapse stress of the casing. This method significantly reduces conservatism necessary in operation of heat injection wells due to unknown formation stresses, unknown variations in formation stress over the course of heat injection operations, and unknown temperatures of casings.

5 Claims, 4 Drawing Sheets

CONTROL OF HEAT INJECTION BASED ON TEMPERATURE AND IN-SITU STRESS MEASUREMENT

This application claims the benefit of U.S. Provisional Application No. 60/049,292 filed on Jun. 11, 1997.

FIELD OF THE INVENTION

The present invention relates to a method to operate heat injection wells within a subterranean formation by determining formation stress as the well is heated and operating the heat injection wellbore at a temperature that varies over the period of operation of the heat injector well but keeps the heat injection well operating near its maximum allowable stress.

BACKGROUND TO THE INVENTION

Stress in subterranean formations are usually determined in order to design formation fracturing operations, but typically these stresses are determined empirically by applying pressure to the formation from a wellbore until a fracture initiates. Typically, formation stresses will not be important variables in design of wellbore tubulars because the tubular strength is dictated by the necessity of the tubular to support a significant length of itself. This is not the case when the wellbore is to be used as a heat injection well in a thermal recovery project.

The casing will only have to support itself until it is cemented into place. This is done when the casing is relatively cool. When the heat injection well is placed in service, the casing will be heated to a temperature that is preferably between about 1400° F. and 2000° F. The thickness of the casing must be sufficiently thick so that, at these conditions, the casing will not buckle due to formation stress.

Even if the initial formation stress is determined prior to beginning heating operation of a heat injection well, the initial stress may not be indicative of the stress over the entire cycle of the heating operation. Measurements of stress in on certain rocks as cores of the rocks are heated up in a constrained volume show a large initial increase in compressive stress. A method to monitor such increase in stress is desirable in order to prevent collapse of a casing as heat is injected into the formation from a heater in the casing. For example, the operating temperature of the well may be limited initially if the formation stress increases initially, and then the operating temperatures might be increased later in the process if formation stresses decrease.

It is therefore an object of the present invention to provide a method to determine to operate heat injection wells wherein the stress within a formation during the operation of a wellbore is determined, and operating temperature limitations are adjusted according to measured formation stresses.

SUMMARY OF THE INVENTION

These and other objectives are accomplished by a method to operate a heat injection well, the method comprising the steps of: providing a heat injection well comprising a metal casing and a controllable source of heat within the casing; determining the maximum temperature of the casing which can be applied to the metal casing as a function of external pressure; providing a formation stress measurement device within the formation in the vicinity of the wellbore; providing a temperature measurement device effective for determining the temperature of the casing;

determining the formation stress during operation of the heat injection well; and controlling heat released from the controllable source of heat to maintain the formation stress below a predetermined fraction of the collapse stress of the casing.

This method significantly reduces conservatism necessary in operation of heat injection wells due to unknown formation stresses, unknown variations in formation stress over the course of heat injection operations, and unknown temperatures of casings. Heat injection rates are limited so that the casing temperatures do not exceed a temperature at which the casing collapse pressure is exceeded. Heat injection rates are preferably limited so that the casing temperatures do not exceed a temperature at which stress on the casing does not exceed fifty percent of the collapse pressure of the casing.

DETAILED DESCRIPTION OF THE INVENTION

Figure 1:
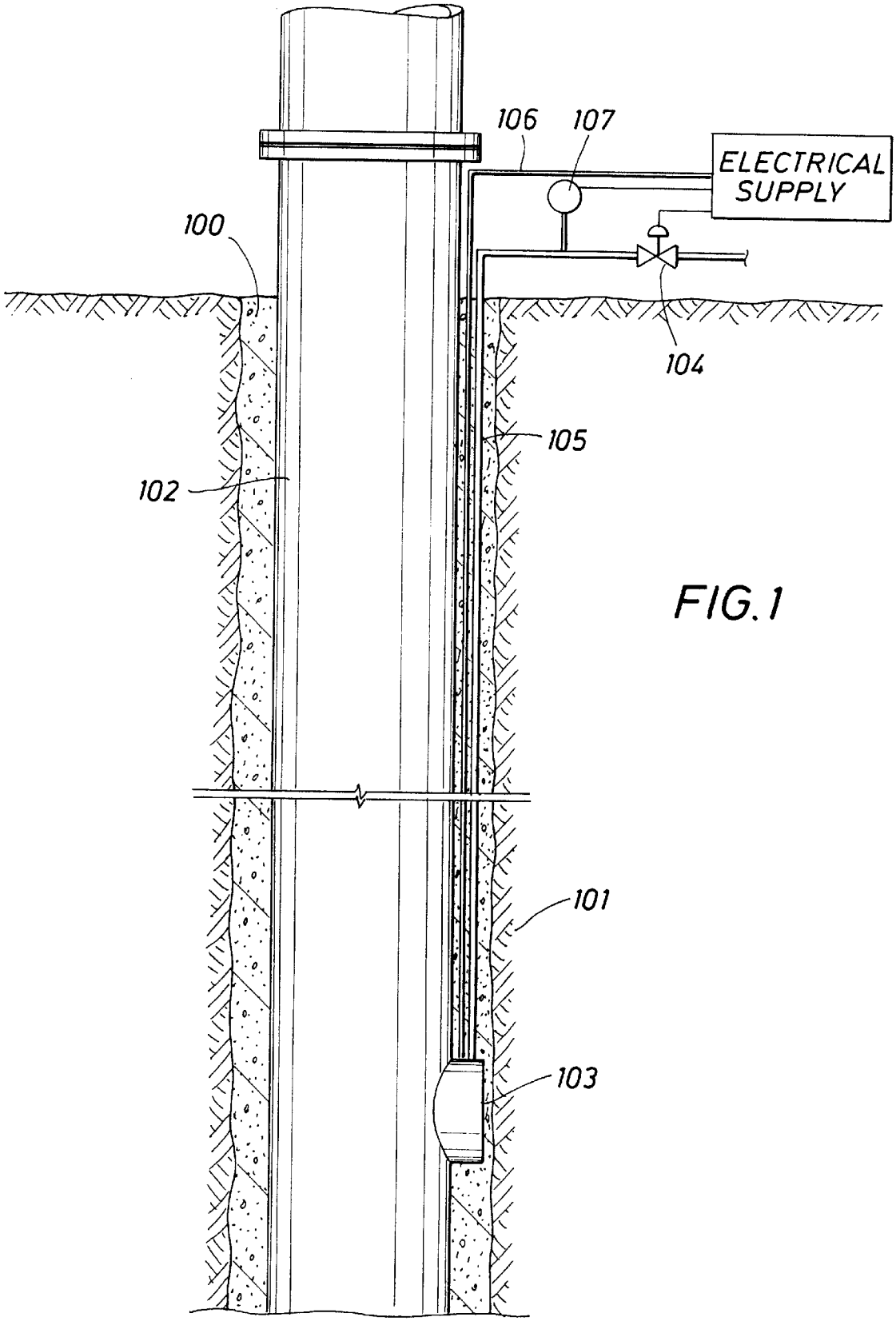
FIG. 1 is a schematic drawing showing the components of an apparatus useful in the practice of the present invention.

The present invention relates to operation of a heat injection well. Heat injection wells can be used in thermal oil recovery methods, such as recovery of oil from diatomite formations, oil shale formations, or tar sands. Heater wells are also useful in soil remediation for vaporizing or decomposing contaminates in the soil. Methods for use of heat injection wells are discussed in, for example, U.S. Pat. Nos. 4,640,352, 4,886,118, 5,190,405, 5,297,626, 5,318,116, and 5,392,854. Heat injection wells may use natural gas or electricity as a source of heat within the wellbore. Such heat injection wells are disclosed in, for example, U.S. Pat. Nos. 5,060,287, 5,065,818, and 5,255,742. The amount of heat released is controlled, for example, depending on the source of heat, varying current of electricity, or varying the flow rate of fuel and/or combustion air.

Maximum operating temperatures of casings as a function of external pressure on the casing are well known in the art. A temperature, for all metals, exists whereat the metal will become ductile, and will fail rapidly. At temperatures below the temperature at which the metal becomes ductile, the metal will fail by a creep mechanism. The rate of creep depends greatly on the pressure exerted on the casing. Thus, knowing the external pressure being placed on the casing by the formation allows operation up to the limit of creep failure at that limited temperature. The relationship between maximum external pressure as a function of temperature can optionally be determined empirically by application of pressures to samples of the casing at different temperatures, but generally, these functions are well known.

Formation stress measurements can be obtained by placement of strain gauges directly on the casing, but this in not the preferred method. These strain gauges are subject to significant zero-shift when the metal is subject to creep and can be easily damaged during installation of the casing. Because the casing of the present invention is likely to be subject to creep, this is a significant problem. Also, strain gauges generate very small differential signals. These small signals are subject to leakage or distortion in the method of the present invention because of the large distances between the strain gauges and the point at which measurements are conveniently taken. Use of strain gauges to determine stress the formation is placing on the casing is therefore not preferred. The apparatus shown in the attached figures and described below is the preferred apparatus to determine the stress being placed on the casing in the practice of the present invention.

Because the temperature of the casing is limited by the stress placed on the casing by the formation, a thermocouple is preferably attached to the casing to monitor the temperature of the casing, and to be used to control heat input to the heat injector. It is most preferred that a plurality of thermocouple be provided in order to obtain a better estimate of the maximum temperature of the casing. If a particular location of the casing is expected to be hottest, that location is the preferred location for at least one of a plurality of thermocouple. For example, the casing may be expected to be hottest near a strata of the formation having less thermal conductivity.

Heat released by the heat injector is controlled in the practice of the present invention at a rate effective to maintain the casing at a temperature at which stress on the casing does not exceed a predetermined fraction of the collapse pressure of the casing at the measured temperature. This predetermined fraction may be, for example, between about thirty and about fifty percent of the collapse pressure.

Referring now to FIG. 1, a wellbore 100 is shown, the wellbore penetrating a formation 101. A casing 102 is provided within the wellbore. A sensor 103 of the apparatus of the present invention is welded to the outside of the casing at a point wherein the formation of interest. Gas from a high pressure supply (not shown) is supplied through a control valve 104 and gas supply line 105. A pressure sensor 107 may be used to determine the pressure downstream of the control valve as a control pressure. An electrical lead 106, preferably connected to a direct current low voltage electrical supply, extends from the surface to the sensor. The sensor will ground the electrical lead when the gas supply pressure is below the pressure exerted on the sensor, and will open the circuit when the pressure supplied to the sensor is above the pressure exerted by the formation on the sensor. Pressure of the gas supplied to the sensor is therefore cycled up and down by the control valve 104, with the stress determined as the pressure at which the electrical contact is broken (when the gas supply pressure is decreasing) or made (when the gas supply pressure is increasing).

Because formation stress varies depending on the radial direction with respect to the casing, the sensor is preferably orientated facing the maximum expected formation stress. Further, it is preferred that the diaphragm dimensions be such that the smallest distance across (diameter for a circular diaphragm) be a significant portion of the diameter of a casing on which stress is being measured. This ensures that the force measured is reflective of the pressure actually being exerted on the casing.

The gas pressure is preferably cycled to pressures the are within a few pounds force per square inch of the last determined formation stress, and cycled relatively slowly. The cycles are preferably of about five minutes to about one hour in duration in order to ensure that the pressure measured near the surface is relatively close to the pressure existing within the sensor, and that the formation has relaxed to result in formation stress pressure resting on the diaphragm. Once fifty percent (or some other predetermined fraction) of the collapse pressure is reached, the cycle frequency can depend on the heating rate or temperature rise rated desired. Typically, about 50° F. per hour is utilized, and the cycle frequency should be at least once per hour.

In a high temperature application of the present invention, such as a heat injection well, the metallurgy of the diaphragm must be carefully selected. An alloy such as MA956, or 602CA is preferred.

Figure 2A:
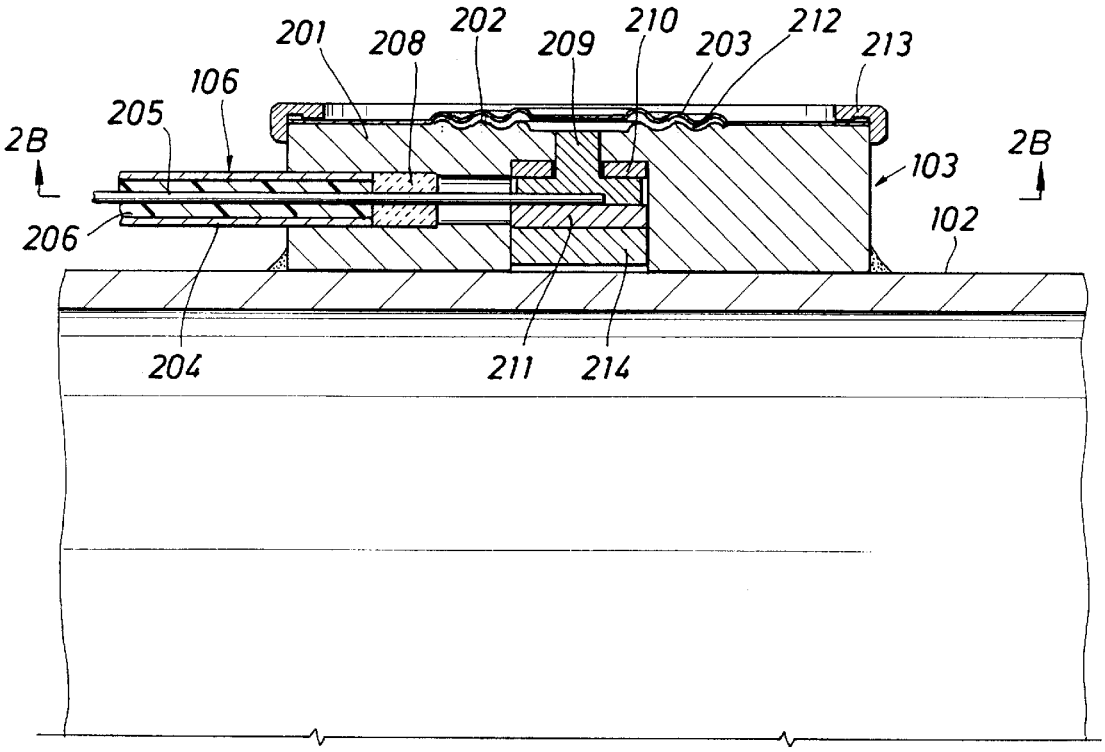
FIGS. 2A and 2B are partial cross sectional views of a sensor for the apparatus useful in the present invention.
Figure 2B:
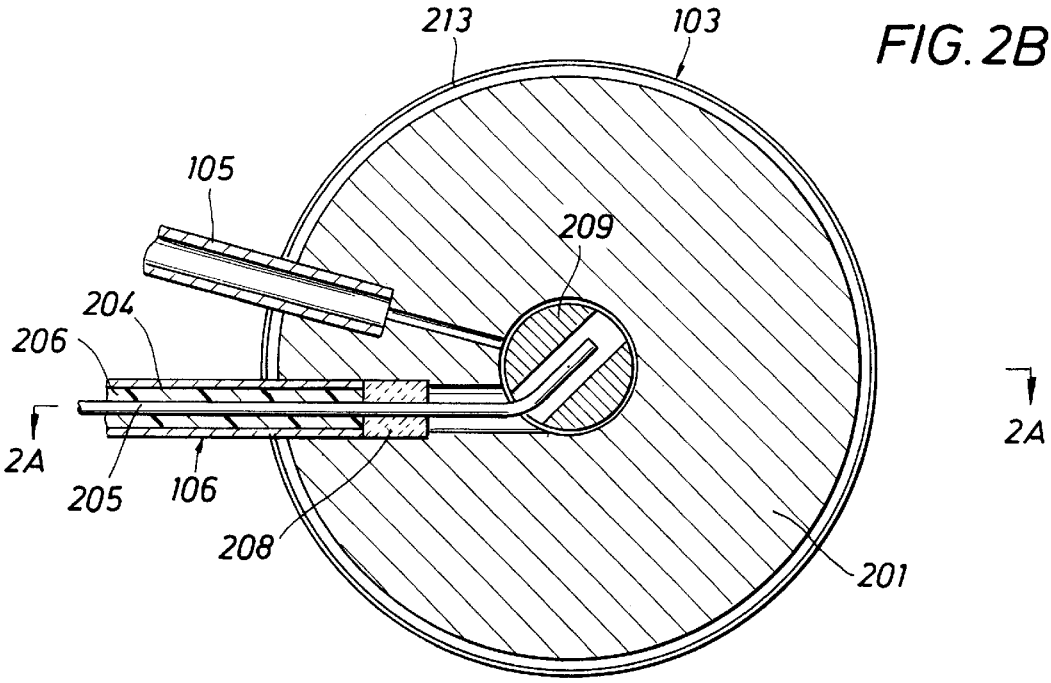

Referring now to FIGS. 2A and 2B, (with elements numbered as in FIG. 1) a sensor useful in the present invention is shown.

This sensor 103 is shown welded onto a casing 102. A body of the sensor 201, provides a formation-facing side 202, that may match the contour of a diaphragm 203. In a preferred embodiment of the present invention, the body behind the diaphragm is conical, and not ridged to match the diaphragm. When the body adjacent to the diaphragm matches the contour of the diaphragm, the diaphragm can be provided improved support when pressed against the body of the sensor, but it has been found that it is difficult to ensure proper alignment of the two surfaces, and if the two surfaces do not remain well aligned, the contours can prevent proper operation of the switch.

An electrical lead 106 with a sheath 204, conductor 205 and insulation 206 provides electrical potential to the sensor. A ceramic plug 208 insulates and provides support for the conduit within the sensor. The conductor is welded to a contactor 209.

The contactor is positioned so that when the diaphragm is relaxed (or pressure on each side of the diaphragm is about equal) the diaphragm is not in contact with the contactor, but when the pressure on the formation side of the diaphragm is slightly greater than the side of the diaphragm that faces the body of the sensor, the diaphragm is forced to contact the contactor. Because the diaphragm is in electrical contact with the body of the sensor, and the body of the sensor is welded to the casing, the diaphragm is electrically grounded.

A ceramic doughnut 210 provides electrical insulation between the contactor from the body of the sensor, and keeps the contactor centered. A metal plug 211 is welded into the back side of the sensor to seal the cavity in which the contactor sits.

The gas supply line 105 provides communication between a controllable source of high pressure gas (not shown) and the volume between the diaphragm and the body of the sensor (the reference pressure volume) 212. The path between the gas supply line and the volume between the diaphragm and the body of the sensor is shown as a gap around the ceramic doughnut 210.

A seal ring 213 is shown around the diaphragm to ensure a secure fit between the diaphragm and the body of the sensor, but it is preferable to have the diaphragm welded directly to the body of the diaphragm by electron beam welding to provide this seal.

A significant feature of the sensor shown in this FIG (and in FIGs. 3A and 3B) is the offset between the centerline of the electrical conduit lead and the center of the contactor. This offset provides enough flexibility to enable thermal expansion of the conductor without stress being placed on the weld connecting the conductor to the contactor. To permit this thermal expansion, the contactor and the ceramic doughnut are round, and allowed to rotate within the body of the sensor.

Figure 3A:
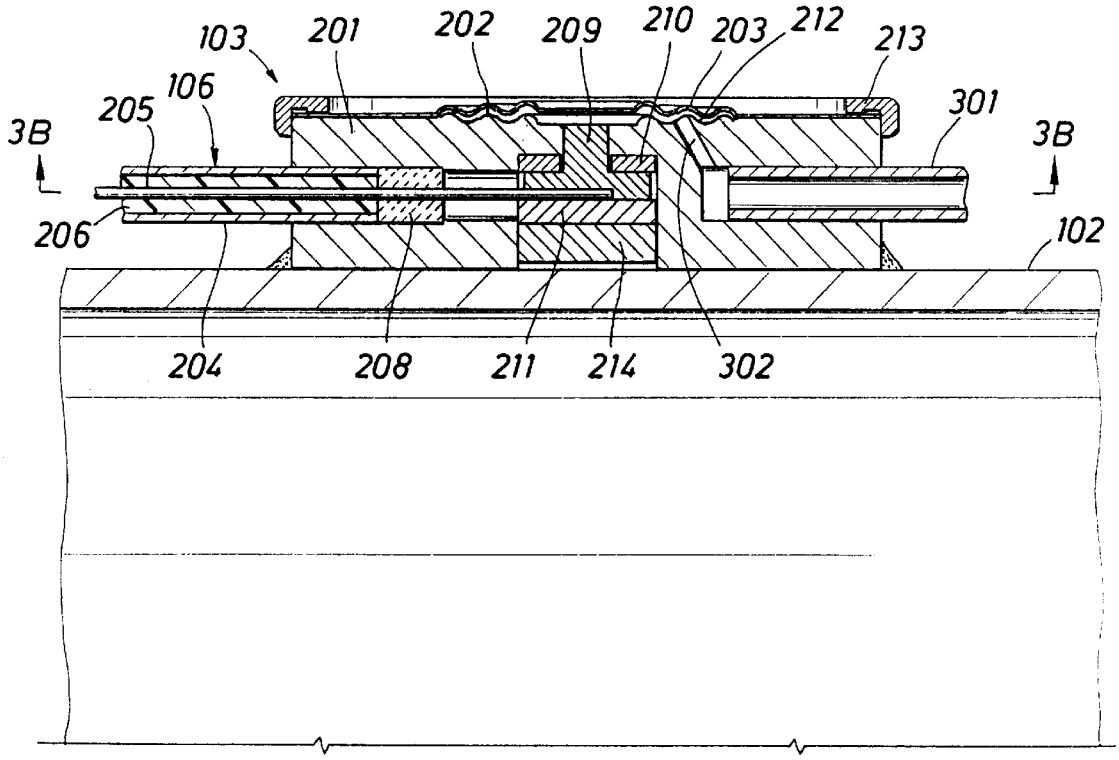
FIGS. 3A and 3B are partial cross sectional views of a sensor for the apparatus useful in the present invention.
Figure 3B:
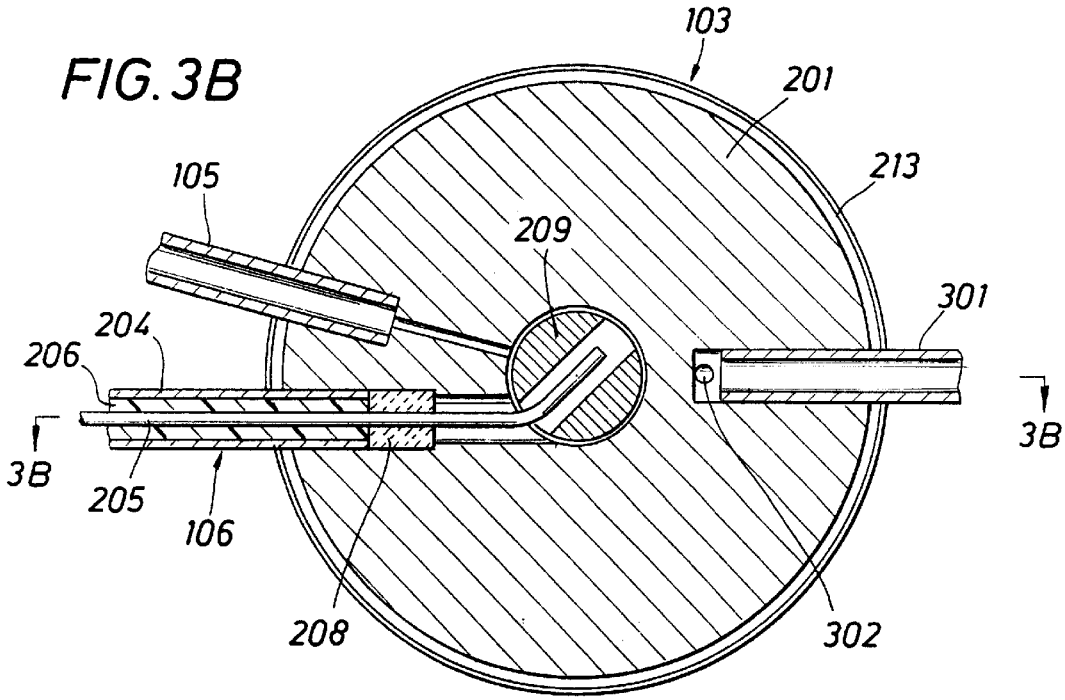

Referring now to FIGs. 3A and 3B, with elements numbered as in the previous figures, another embodiment of the present invention is shown. The improvement of this embodiment is provision of a return gas conduit 301. This conduit is in communication with a channel 302 that leads to the volume between the diaphragm and the body of the sensor. In this embodiment it is preferred that the contactor not extend significantly past the surface of the body of the sensor. Thus, when the diaphragm is pressed against the contactor, the gas supply is separated from the return gas conduit. The diaphragm acts as a valve and closes the flowpath.

Thus a pressure or flow of gas at the surface from the return gas conduit can be used to determine if the diaphragm is pressed against the body of the sensor. The return gas flow or pressure can therefore be used as a back-up indication of the position of the diaphragm, or as the only means if the electrical signal is not utilized.

A return gas flow conduit could also provide a purge for the system, or a flow from which a sample can be withdrawn to determine if the sensor is leaking.

Figure 4:
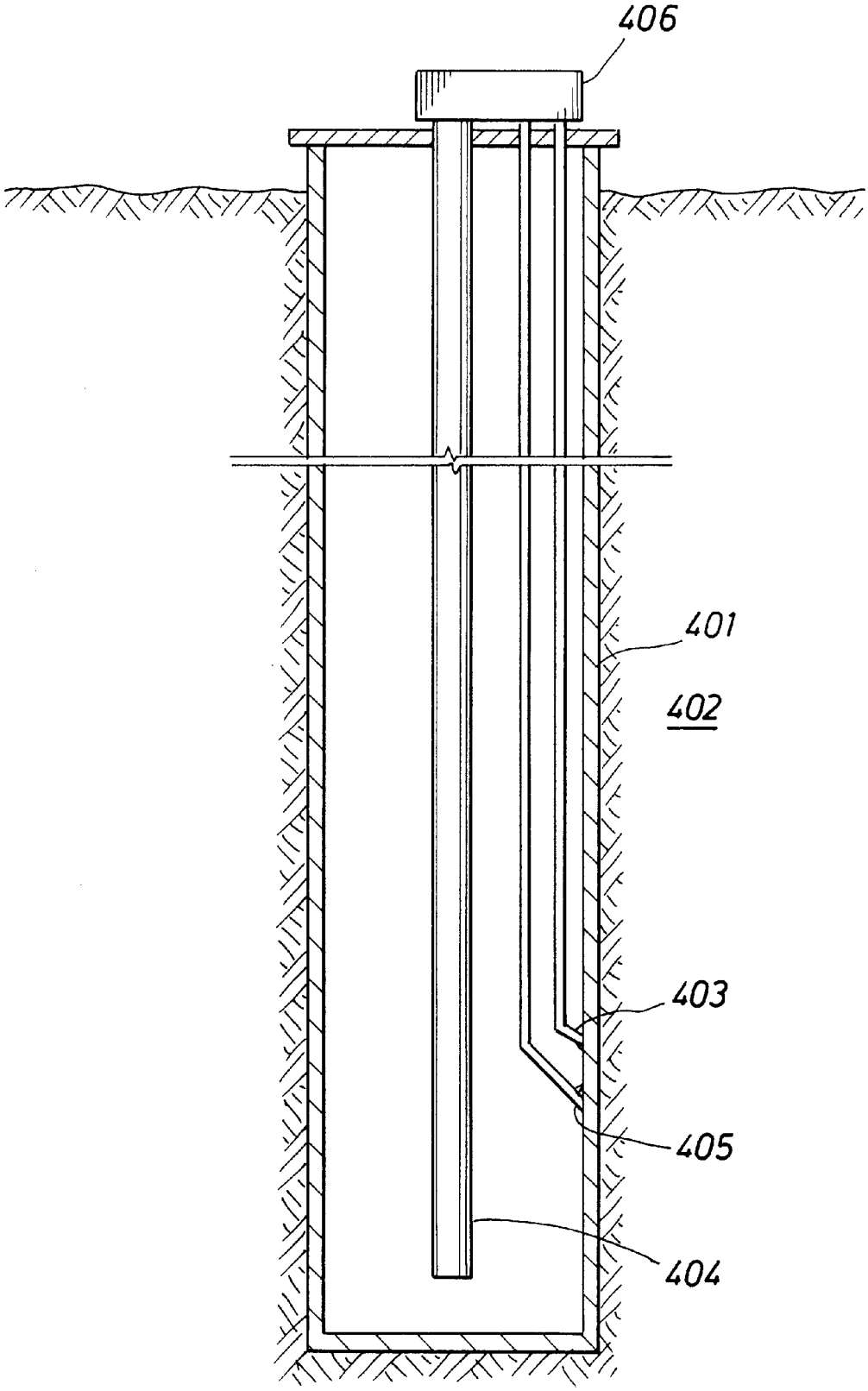
FIG. 4 is a schematic of a heater in a wellbore with a temperature sensor and formation stress measurement device.

Referring now to FIG. 4, a casing 401 is in a formation 402 with a thermocouple 403 mounted on the inside of the casing and an electrically fired heater 404 inside the casing. A controller 406 controls current to the heater. A strain gauge 405 is shown to determine the formation pressure on the casing with a signal from the strain gauge as an input to the controller 404.

The method of the present invention is preferably applied to at least an initial heat injection well placed in a particular formation, and after a pattern of changes and ranges of formation stress is determined, heat injection wells can be installed and operated using a pattern of heat injection, or casing temperature profiles without the need to monitor the actual formation stress. It is preferred that at least a plurality of heat injection wells be provided with a device to determine formation stress, but a single heat injection well could be provided with such a device, and other heat injection wells operated according to the single measured stress.

Stress measurement devices could be provided at more than one location along the depth of a well. Providing more than one stress measurement devices may be needed if the heat injection well penetrates reservoir rocks having substantial variations in geological characteristics.

I claim:

1. A method to operate a heat injection well, the method comprising the steps of:

providing a heat injection well comprising a metal casing and a controllable source of heat within the casing;

determining a collapse stress as the maximum external pressure which can be applied to the metal casing as a function of temperature;

providing a formation stress measurement device within the formation in the vicinity of the wellbore;

providing a temperature measurement device effective for determining the temperature of the casing;

determining the formation stress during operation of the heat injection well; and controlling heat released from the controllable source of heat to maintain the formation stress less than a predetermined fraction of the collapse stress of the casing.

2. The method of claim 1 wherein the predetermined fraction represents between about 30% and about 50% of the collapse stress of the casing.

3. The method of claim 1 wherein the temperature measurement device comprises a plurality of thermocouples attached to the casing.

4. The method of claim 1 wherein the stress measurement device within the formation in the vicinity of the wellbore is provided attached to a casing of a heat injection well.

5. The method of claim 1 wherein a plurality of stress measurement devices are provided on the casing.

* * * * *